United States Patent [19]

Vaznaian et al.

[11] Patent Number: 4,827,888

[45] Date of Patent: May 9, 1989

[54] NOZZLE

[75] Inventors: Dale L. Vaznaian; Michael J. Thermos, both of Huntington Beach, Calif.

[73] Assignee: Nitrous Oxide Systems, Inc., Cypress, Calif.

[21] Appl. No.: 184,334

[22] Filed: Apr. 21, 1988

Related U.S. Application Data

[63] Continuation of Ser. No. 868,938, May 30, 1986, Pat. No. 4,798,190.

[51] Int. Cl.[4] ..... F02M 25/10; F02M 67/06

[52] U.S. Cl. ..... 123/531; 123/1 A; 239/424

[58] Field of Search ..... 123/531–535, 123/1 A; 239/424

[56] References Cited

U.S. PATENT DOCUMENTS

| | | | |
|---|---|---|---|
| 622,482 | 4/1899 | Jackson | 239/424 X |
| 1,627,727 | 5/1927 | Charter | 123/531 |
| 2,482,864 | 9/1949 | Nemnich | 123/533 |
| 3,182,646 | 5/1965 | Kuechenmeister | 123/533 |
| 3,610,213 | 10/1971 | Gianini | 123/531 |
| 4,157,084 | 6/1979 | Wallis | 123/532 X |
| 4,211,200 | 7/1980 | Rocchio et al. | 123/445 |
| 4,494,488 | 1/1985 | Wheatley | 123/1 A |
| 4,572,140 | 2/1986 | Wheatley | 123/1 A X |

*Primary Examiner*—Tony M. Argenbright

*Attorney, Agent, or Firm*—Blakely, Sokoloff, Taylor & Zafman

[57] ABSTRACT

An injection nozzle utilizing nitrous oxide to aid in the introduction and atomization of fuel into a combustion chamber. The present invention comprises a Y shaped nozzle having a pair of input ports and a single output port. One input port is utilized to introduce nitrous oxide into a hollow sleeve of the nozzle and ultimately exiting at the output port. The second input port introduces fuel to the nozzle. A fuel line coupled to the second input port extends the length of the hollow nozzle, terminating at the output port extends the length of the hollow nozzle, terminating at the output port. The nitrous oxide is introduced at high pressure, approximately 500–1000 PSI. The fuel is introduced at approximately 3–12 PSI. As the nitrous oxide exits past the end of the fuel line, it creates a vacuum which aids in drawing the fuel from the line. In addition, the high pressure and vaporization of the nitrous oxide atomizes the fuel so that it is fully dispersed and once within the combustion chamber may be more efficiently burned.

4 Claims, 2 Drawing Sheets

NOZZLE

This is a continuation of application Ser. No. 868,938, filed May 30, 1986, now U.S. Pat. No. 4,798,190.

BACKGROUND OF THE INVENTION

1. Field of the Invention

This invention relates to the field of injection systems in general and to the field of providing a non pressure regulated nitrous oxide/fuel mixture to a combustion cylinder, in particular.

2. Background

In internal combustion engines, a mixture of air and fuel is burned in a combustion chamber (cylinder) with the force generated by the combustion being utilized to provide mechanical energy such as to turn a drive shaft. Typically, the air and fuel are mixed prior to their introduction to the cylinder, such as for instance, in a carburetor. In order to increase the efficiency of the combustion process, it is often desired to "inject" the fuel into the combustion chamber. In an injection system, the fuel and air are separately introduced to the combustion chamber. There, mixing occurs and, ideally, the fuel is vaporized. Such vaporization maximizes the surface area of fuel exposed to oxygen at a given time. This increases the speed and efficiency of combustion. In the prior art, this injection is accomplished by the use of nozzles that inject fuel into a port, which is manifolding air into the combustion chamber.

For high performance it is sometimes desired to introduce nitrous oxide into the combustion chamber along with the fuel. The nitrous oxide/fuel mixture is more combustible than air and fuel alone, leading to greater energy in the burn and consequently increased mechanical energy. In order to maximize the efficiency of the nitrous oxide/fuel mixture combination, it is desired to inject the mixture in an atomized form to form a fog with a multitude of small fuel droplets. In addition, it is desired to utilize the nitrous oxide as a means of atomizing the air/fuel mixture.

A disadvantage with prior art injection systems utilizing nitrous oxide is the poor mixing of the nitrous oxide and fuel. The nitrous oxide is highly pressurized, often in the range of 500–1000 PSI. The fuel, however, is under low pressure, typically approximately 7 PSI. When typically a separate nitrous oxide nozzle and fuel nozzle are used to mix the nitrous oxide and fuel, the fule is injected in the form of a stream that is splattered about the manifold and will puddle in the manifold or the combustion chamber, and will therefore by very difficult to ignite. This combination is not efficient for the amount of fuel being used (injected).

Therefore, it is an object of the present invention to provide a means for injecting a nitrous oxide/fuel mixture to a combustion chamber, such as a cylinder of an internal combustion engine, without inhibiting combustion because the fuel is entering the combustion chamber in a non vaporized from.

It is a further object of the present invention to provide a means of injecting fuel into a combination chamber in which nitrous oxide is introduced into the mixture and is used to aid in the atomizing of the fuel.

SUMMARY OF THE PRESENT INVENTION

An injection nozzle utilizing nitrous oxide to aid in the introduction and atomization of fuel into a combustion chamber. The preferred embodiment of the invention comprises a Y shaped nozzle having a pair of input ports and a single output port. One input port is utilized to introduce nitrous oxide into a hollow sleeve of the nozzle and ultimately exiting at the output port. The second input port introduces fuel to the nozzle. A fuel line coupled to the second input port extends the length of the hollow nozzle, terminating at the output port. The nitrous oxide is introduced at high pressure, approximately 500–1000 PSI. The fuel is introduced at approximately 7 PSI. As the nitrous oxide exits past the end of the fuel line, it creates a vacuum which aides in drawing the fuel from the line. In addition, the high pressure of the nitrous oxide atomizes the fuel so that it is fully dispersed within the combustion chamber and may therefore by more efficiently burned.

DESCRIPTION OF THE PRESENT INVENTION

A nozzle for injecting a combination of nitrous oxide and fuel is described. In the following description, numerous specific details are set forth, such as nitrous oxide pressure, fuel pressure, etc. in order to provide a more thorough understanding of the present invention. It will be obvious, however, to one skilled in the art, that the present invention may be practiced without these specific details. In other instances, well known features have not been described in detail in order not to unnecessarily obscure the present invention.

Figure 1:
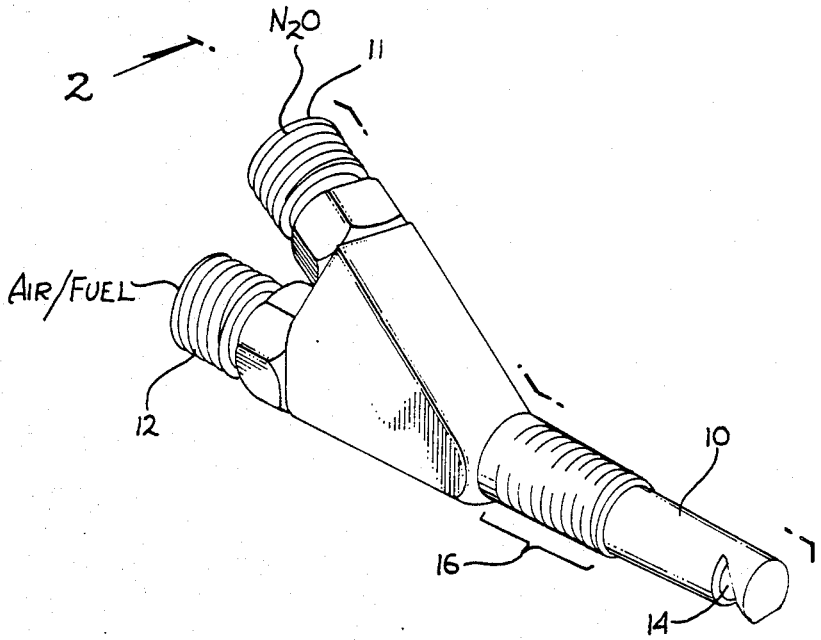
FIG. 1 is a perspective view of the nozzle of the preferred embodiment of the present invention.

Referring to FIG. 1, a perspective view of the present invention is illustrated. Externally, the present invention comprises a Y shaped structure consisting of input ports 11 and 12 each terminating in elongated member 10 having an output port 14 at the end thereof. In the preferred embodiment of the present invention, nitrous oxide ($N_2O$) is coupled to input port 11. Typically, the nitrous oxide is introduced to the nozzle of the present invention at approximately 500 to 1000 PSI.

Fuel is introduced to the nozzle of the present invention at input port 12. The fuel is pressurized in the range of approximately 3–12 PSI.

The member 10 is generally cylindrically shaped and hollow. As shown in FIG. 1, the output port 14 is an angular opening in the side of member 10. The output port 14 is configured so as to provide the optimum angle of introduction of the nitrous oxide/fuel mixture to the manifold port leading to the combustion chamber. In the preferred embodiment of the present invention, air is supplied to the combustion chamber through the same manifolding.

Figure 2:
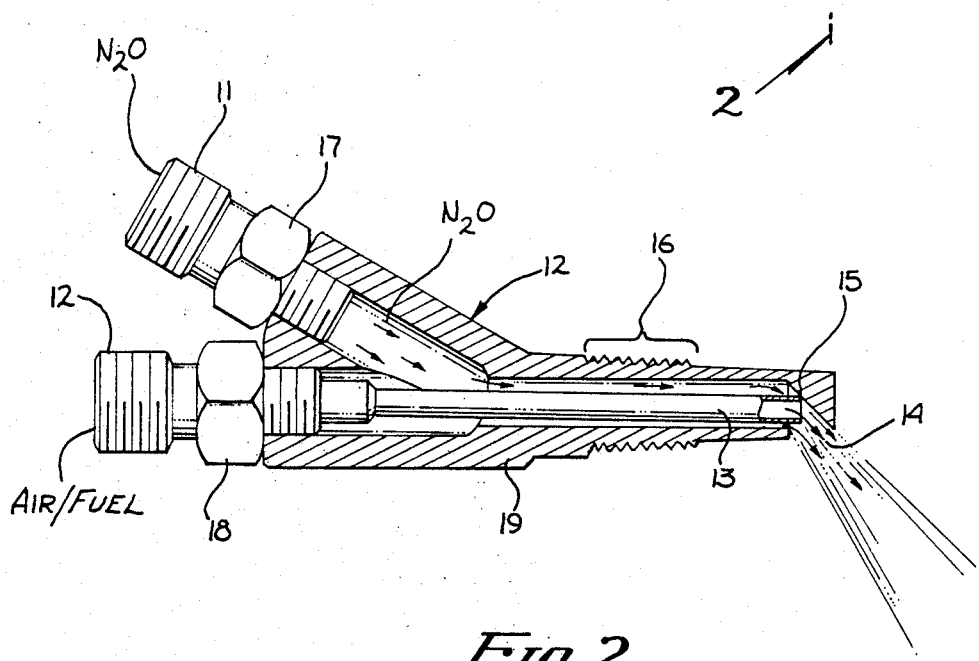
FIG. 2 is a cutaway view of the present invention taken along section line 2—2 of FIG. 1.

A cross-sectional view of the present invention is illustrated in FIG. 2. A fuel line 13 is coupled to input port 12 and extends through the member 10, terminating at output port 14. Fuel line 13 has an opening 15 coincident with output port 14. The fuel line 13 ensures that no mixing of the nitrous oxide and fuel occurs prior to exiting the nozzle. The inner diameter of the member 10 is larger than the diameter of the fuel line 13. This allows the nitrous oxide to enter the nozzle and flow around the fuel line to the output port 14.

The nitrous oxide, in the preferred embodiment, enters the nozzle housing in liquid form. The liquid nitrous oxide is pressurized at approximately 800 PSI. Upon entering the nozzle housing, there is a pressure drop to approximately 500 PSI. The liquid nitrous oxide begins to change to the gaseous state in the nozzle housing. The vaporization serves to cool the fuel line within the nozzle.

At the output port 14, the high pressure nitrous oxide gas exits the nozzle, and thereby creates a vacuum in the fuel line 13, drawing fuel into the stream of nitrous oxide and into the manifold port leading to the combination chamber. The pressure and the vaporization of the nitrous oxide helps disperse the fuel into tiny droplets, exposing a greater surface area of fuel so that oxidation is more rapid and more complete. This results in increased mechanical efficiency of the engine. By combining the nitrous oxide and fuel ports into a single nozzle, the prior art problem of puddled fuel flow is overcome. The nozzle of the present invention allows the high pressure nitrous oxide to flow past the fuel opening, creating the low pressure area which draws the fuel out. In prior art two nozzle systems, it is impossible to position the output nozzles sufficiently close together to perform as does the nozzle of the present invention. Prior art systems, in addition to the fuel flow problem, do not provide the atomizing effect of the present nozzle. In the present invention, the mixing of the fuel with the nitrous oxide begins at the moment the fuel exits the fuel line 13.

As noted previously, the output port is an angled opening formed in the outlet member 10. It will be obvious that other configurations and positions of outlet ports may be utilized. However, in the preferred embodiment, the angled outlet port is chosen to provide the optimum angle of entry of the nitrous oxide/fuel mixture to the manifold port to the combustion chamber.

The base structure 19 of the nozzle of the present invention is formed of aluminum. Threaded openings are formed in the base member 19. Threaded coupling members 17 and 18 are then inserted in the threaded openings to form inlet ports 11 and 12. As previously noted, fuel line 13 is coupled to inlet port 12. In the preferred embodiment of the present invention, the coupling members 17 and 18, and the fuel-line 13, are made of brass. Base member 19 includes threaded region 16 on member 10. This threaded region 16 allows the nozzle of the present invention to be easily mounted into a threaded opening in a manifold port leading to the combustion chamber.

It may be desired to utilize the present invention on a standard production engine. For example, an automobile owner may wish to modify his engine to have the capability of utilizing nitrous oxide to increase the efficiency of his engine. However, it is not always possible or desirable to add additional ports to an engine. Therefore, an alternate embodiment of the device of the present invention is described to allow the introduction of a nitrous/fuel mixture to an engine through the engine's carburetor.

Figure 3:
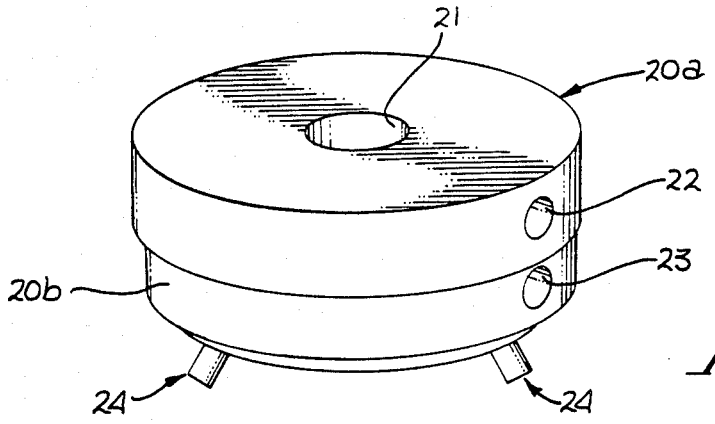
FIG. 3 is a perspective view of an alternate embodiment of the present invention.
Figure 4:
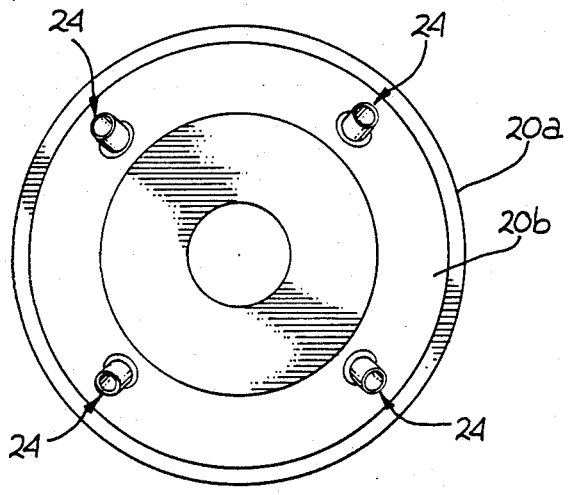
FIG. 4 is a bottom view of the device of FIG. 3.

This alternate embodiment of the present invention is shown in FIG. 3. The device comprises a top section 20A for introducing fuel to the device and a bottom section 20B for introducing liquid or gaseous nitrous oxide. An opening 22 is formed in the top section 20A for introducing fuel to the device. Opening 23 in bottom section 20B is for introducing liquid or gaseous nitrous oxide to the device. The nitrous/fuel mixture exits the device at outlet ports 24. The device is contemplated for use with a four barrel carburetor and correspondingly there are four outlet ports 24, as shown in the bottom view of Figure 4. The device has equal application to any size carburetor, and the number of outlet ports 24 may be varied without departing from the scope of the present invention.

On many engines, a bolt extends from the carburetor and is used for mounting an air cleaner over the carburetor. A bore 21 formed through section 20A and 20B is utilized for mounting the device on such an air cleaner mounting bolt. After mounting on the bolt, the device is oriented so that each output port 24 is directed to an inlet opening in the carburetor.

Figure 5:
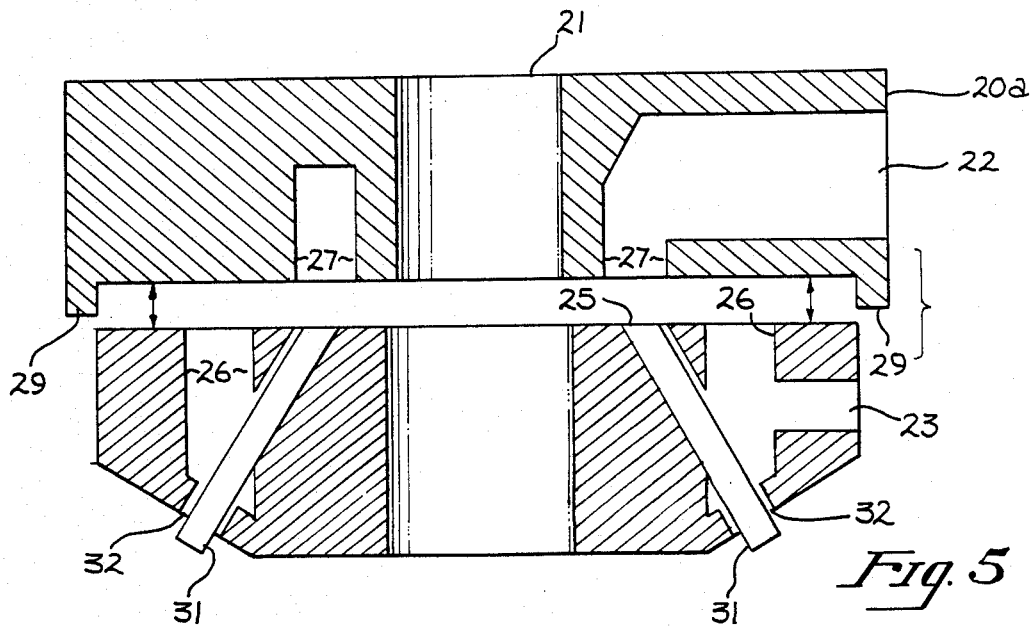
FIG. 5 is a cross-sectional partially exploded view of the device of FIG. 3.

Sections 20A and 20B are shown in cross section in FIG. 5, which is a partially exploded view of the alternate embodiment of the invention. Opening 22 accesses groove 27 in section 20A. Fuel is introduced to opening 22 and is distributed throughout groove 27. Groove 27 extends completely around and is concentric with opening 21. Section 20A includes extending edge 29 around its circumference. This edge 29 insures proper registration and alignment of section 20B when it is combined with section 20A.

Section 20B has formed therein a groove 26 extending about and concentric with opening 21. Groove 26 is of larger radius then groove 27 in this embodiment. Opening 23, formed in the side of section 20B permits the introduction of liquid or gaseous nitrous oxide to groove 26.

Also formed in section 20B is opening 25 extending through section 20B to outlet opening 32. Opening 25 is such that when sections 20A and 20B are combined, section 25 accesses groove 27 of section 20A. A fuel line 31 is inserted into opening 25. In this embodiment, fuel line 31 achieves a pressure fit with opening 25 Outlet opening 32 is of greater diameter than opening 25 so that fuel line 31 does not seal off opening 32. When sections 20A and 20B are combined, fuel is introduced into opening 22 and is distributed throughout groove 27. The fuel then flows into fuel line 31 at opening 25. At the same time, nitrous oxide is introduced to groove 26 of section 20B. After entering groove 26, the nitrous oxide, if liquid when introduced, changes to gaseous form and exits section 20B at outlet opening 32. As with the single nozzle construction, the fuel is introduced at approximately 7 PSI and the nitrous oxide is pressurized at approximately 800 PSI. As the highly pressurized gaseous nitrous oxide exits outlet opening 32, it speeds past the opening of fuel line 31, creating a low pressure area at the mouth of fuel line 31 and drawing fuel into the stream of nitrous oxide. As the fuel exits the fuel line 31, it is immediately mixed with the nitrous oxide into a very fine mist. The mist is directed to inlet ports of the carburetor and ultimately into the combustion chambers of the engine.

As with the single nozzle construction, the fuel in this embodiment may be pressurized in the range of 3 to 12 PSI and the nitrous oxide may be pressurized in the range of 500 to 1000 PSI. Although this embodiment is shown to be manufactured in two sections, it will be obvious that it may be made as a single construction if desired.

Thus, a unique nozzle has been described which provides superior mixing of nitrous oxide and fuel in a combustion chamber.

We claim:

1. A method of injecting a mixture of fuel and nitrous oxide into a combustion chamber of an internal combustion engine, comprising the steps of:

conveying said nitrous oxide from a first reservoir to a first input port of an injection device at a first pressure;

conveying said fuel from a second reservoir to a second input port of said injection device at a second pressure, said second pressure being greater than atmospheric pressure and substantially less than said first pressure;

releasing said nitrous oxide through an exit port in said injection device such that a low pressure area is created adjacent to said exit port into which said fuel flows;

allowing said fuel and said nitrous oxide to mix and enter said combustion chamber.

2. In an internal combustion engine, a device for introducing fuel and an oxidizing agent, said oxidizing agent being different from ambient air, into a combustion chamber of said engine, said device comprising:

a first reservoir containing said oxidizing agent ;

a second reservoir containing said fuel ;

a housing having first and second input ports and first and second output ports wherein said first reservoir is connected to said first input port by a tubular supply line and said second reservoir is connected to said second input port by a second tubular supply line;

Said first and second input ports being disposed such that said oxidizing agent exits said housing at said first output port and said fuel exits said housing at said second output port, said first output port being immediately adjacent to said second output port, and said output ports being located near an outer surface of said housing.

3. The device as defined in claim 22, wherein said oxidizing agent is under a greater pressure than said fuel.

4. The device of claim 3 wherein said oxidizing agent is nitrous oxide.

* * * * *

UNITED STATES PATENT AND TRADEMARK OFFICE

CERTIFICATE OF CORRECTION

PATENT NO. : 4,827,888

DATED : 5/9/89

INVENTOR(S) : Vaznaian et al.

It is certified that error in the above-identified patent and that said Letters Patent is hereby corrected as shown below:

| | | |
|---|---|---|
| col. 01, line 51 | delete "by" | insert --be-- |
| col. 01, line 61 | delete "combination" | insert --combustion-- |
| col. 03, lines 14-15 | delete "combination" | insert --combustion-- |
| col. 06, line 18 | delete "22" | insert --2-- |

Signed and Sealed this

Eleventh Day of June, 1991

*Attest:*

*Attesting Officer*

HARRY F. MANBECK, JR.

*Commissioner of Patents and Trademarks*